US008651009B2

(12) United States Patent
Hayden et al.

(10) Patent No.: US 8,651,009 B2
(45) Date of Patent: Feb. 18, 2014

(54) CONTROL MECHANISM SECURABLE TO A FIRING DEVICE AND METHOD

(75) Inventors: John Hayden, Aurora, IL (US); Krzysztof Grzyb, Aurora, IL (US)

(73) Assignee: Control Solutions LLC, Aurora, IL (US)

( * ) Notice: Subject to any disclaimer, the term of this patent is extended or adjusted under 35 U.S.C. 154(b) by 427 days.

(21) Appl. No.: 12/893,878

(22) Filed: Sep. 29, 2010

(65) Prior Publication Data

US 2012/0144991 A1 Jun. 14, 2012

(51) Int. Cl.
*F41A 27/28* (2006.01)

(52) U.S. Cl.
USPC ..... 89/41.02

(58) Field of Classification Search
USPC ..... 89/41.02, 40.03, 37.16, 37.17; 42/84, 42/90
See application file for complete search history.

(56) References Cited

U.S. PATENT DOCUMENTS

| | | | | |
|---|---|---|---|---|
| 2,605,033 | A * | 7/1952 | Terry | 224/0.5 |
| 5,080,289 | A * | 1/1992 | Lunzer | 239/690 |
| 5,092,505 | A * | 3/1992 | Olschlager | 224/150 |
| 5,121,564 | A * | 6/1992 | Story | 42/90 |
| 5,265,365 | A * | 11/1993 | Finn | 42/74 |
| 6,031,439 | A * | 2/2000 | Adams et al. | 335/205 |
| 6,285,146 | B1 * | 9/2001 | Harlan | 318/400.04 |
| 6,374,719 | B1 * | 4/2002 | Phillips | 89/34 |
| 6,874,618 | B1 * | 4/2005 | Cragg | 206/3 |
| 7,030,579 | B1 * | 4/2006 | Schmitz et al. | 318/139 |
| 7,540,107 | B2 * | 6/2009 | Oum | 42/71.01 |
| D634,387 | S * | 3/2011 | Grzyb et al. | D22/108 |
| 2008/0000131 | A1 * | 1/2008 | Oum | 42/71.01 |
| 2011/0016764 | A1 * | 1/2011 | Cales | 42/90 |
| 2011/0023698 | A1 * | 2/2011 | Hayden et al. | 89/41.02 |
| 2011/0139139 | A1 * | 6/2011 | Knuth et al. | 124/77 |

* cited by examiner

*Primary Examiner* — Jonathan C Weber

(74) *Attorney, Agent, or Firm* — McCracken & Frank LLC

(57) ABSTRACT

A control mechanism securable to a firing device is provided. The control mechanism includes an actuation component adapted to generate signals in response to activation of the actuation component. Further, the control mechanism includes an attachment apparatus adapted to support the actuation component adjacent to a stock of the firing device. The attachment apparatus has at least one securing member for securement of the attachment apparatus to the stock of the firing device.

27 Claims, 10 Drawing Sheets

CONTROL MECHANISM SECURABLE TO A FIRING DEVICE AND METHOD

FIELD OF THE INVENTION

This invention relates to control mechanisms for sending signals to a controller and, more particularly, to control mechanisms that are securable to a firing device of an armored vehicle.

BACKGROUND

For military operations, armored vehicles may be equipped with turret-mounted firing devices. The turrets of the armored vehicles may also be equipped with a drive system that enables an operator to rotate the turret when aiming the weapon. An operator may control the rotation of the turret through the use of various devices. One such device is a hand-operated joystick attached to a magnetic base with a metallic underside. The metallic underside of the hand-operated joystick provides the benefit of allowing the turret operator to position the joystick at a location on or within the vehicle. However, operators may need to remove at least one hand from the firing device to operate the joystick.

Another type of turret control device may be mounted to the hand grips of a weapon, such as a .50 caliber machine gun. This device allows an operator to control the rotation of the turret via his or her thumbs while holding the handles of the weapon. These types of control devices may be referred to as "thumbsticks." Like the hand-operated joysticks, an operator may use his or her thumbs to rotate the turret. Such thumbsticks are often used with "butterfly" style hand grips, i.e., a pair of adjacent vertical grips that an operator grasps when operating the weapon. Thumbstick devices, however, may be impractical for use with other types of firing devices.

Therefore, a need exists for a control mechanism that is releasably mountable to the stock of a firing device.

SUMMARY

A control mechanism securable to a firing device is provided. The control mechanism includes an actuation component adapted to generate signals in response to activation of the actuation component. Further, the control mechanism includes an attachment apparatus adapted to support the actuation component adjacent to a stock of the firing device. The attachment apparatus has at least one securing member for securement of the attachment apparatus to the stock of the firing device.

A control system for generating control signals with a control mechanism securable to a firing device is also provided. An actuation component is adapted to generate control signals in response to activation of the actuation component. An attachment apparatus is adapted to support the actuation unit adjacent to a stock of the firing device. The attachment apparatus has at least one securing member for securement of the attachment apparatus to the stock of the firing device. A controller is coupled to the actuation component for receiving the control signals generated by the actuation component.

A method of operating a control mechanism securable to a firing device is further provided. The method includes securing an attachment apparatus of the control mechanism to a stock of the firing device. The attachment apparatus mounts an actuation component adapted to generate control signals transmittable to a controller. Additionally, the method includes moving an actuator of the actuation component such that the actuation component generates control signals corresponding to directional movement of the actuator.

DETAILED DESCRIPTION

As shown herein, a control mechanism securable to a firing device is described. Further, a control system for generating control signals with a control mechanism securable to a firing device and a method of operating a control mechanism securable to a firing device are also described. In particular, a control mechanism may be mounted to the stock of a firing device allowing for simultaneous aiming and operation of the firing device and actuation of the control mechanism. As described herein, a control mechanism is discussed in reference to an example application of traversing a rotatable turret of a vehicle. However, those skilled in the art will recognize that the control mechanism mountable to a firing device described herein may be used in a variety of applications to control a variety of components or systems. Accordingly, the discussion of the control mechanism in reference to a rotatable turret of an armored vehicle is by way of example only and should not be construed to limit the invention to any particular use or application.

Figure 1:
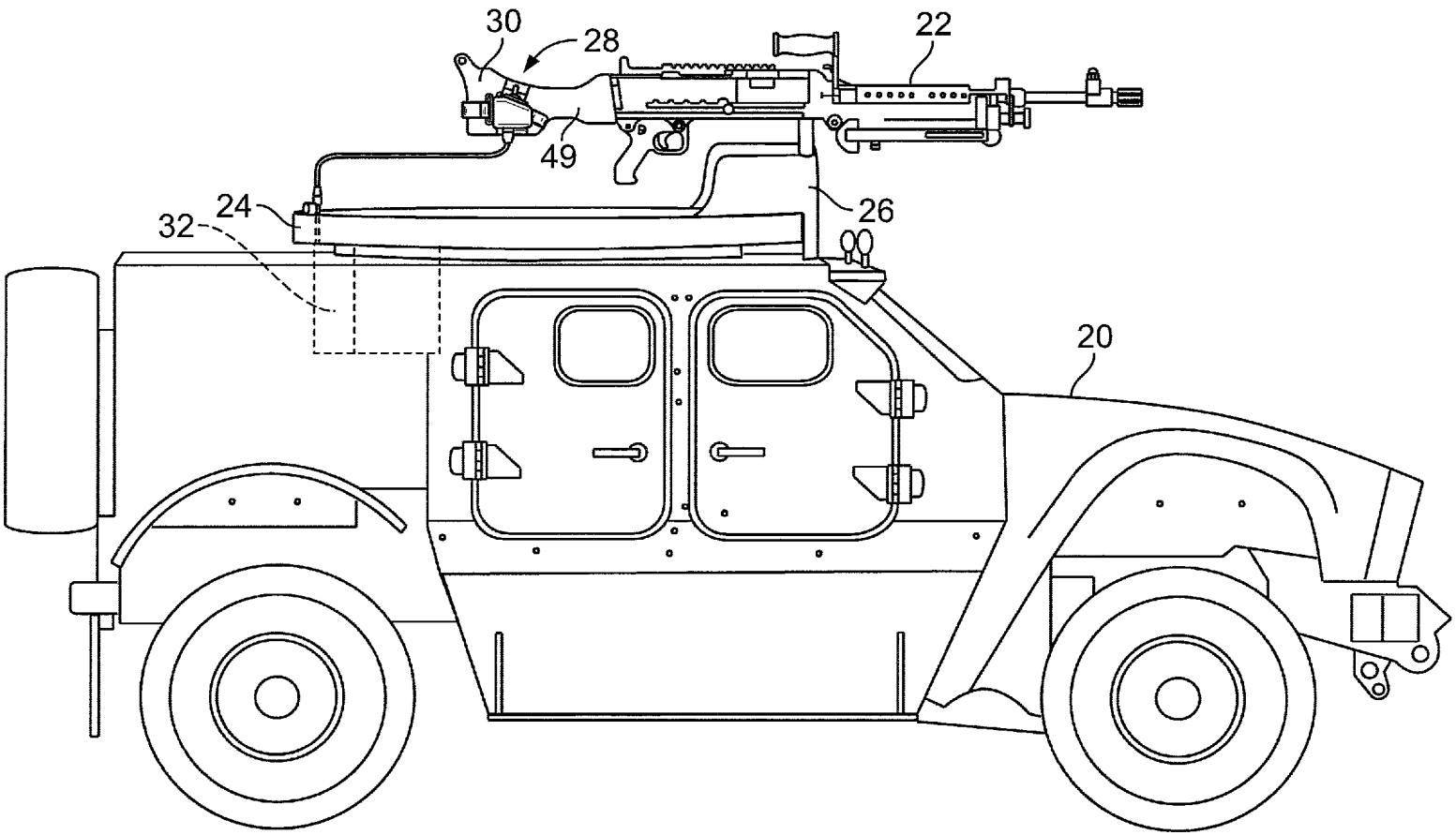
FIG. 1 is a profile view of an armored vehicle having an control mechanism mounted to the stock of a firing device of a rotatable turret.

Referring now to FIG. 1, a right profile view of an armored vehicle 20 having a firing device 22 mounted to a rotatable turret 24 is shown. The turret may fully rotate 360° in a clockwise or counterclockwise direction. The turret 24 may include, among other components, shielding 26 to protect an operator (FIG. 7) during operation of firing device 22. In the example shown, the firing device 22 is an M240 machine gun (United States military designation Machine Gun, 7.62 mm, M240). The M240 is designed to be operated by the right hand of an operator. This is because the spent cartridges from the M240, in this example, are expelled from the right side of the gun. Accordingly, operators are trained to position their bodies to the left of the gun and grip the gun with their right hand.

As shown in FIG. 1, a control mechanism 28 is secured to the stock 30 of the firing device. The control mechanism 28 may be coupled or connected to a controller 32 situated beneath the rotatable turret 24 and within the vehicle 20 as seen in FIG. 1. The control mechanism 28 may be used to generate control signals, which are sent to and received at the controller 32. One application of the control mechanism 28, as shown in FIG. 1, includes controlling the rotation of a vehicle turret 24 based on the control signals received from the control mechanism. As described further below, the controller 32 may be connected to a drive system (FIG. 6) that drives the rotation of the turret 24 in a clockwise or counterclockwise direction in response to receipt of the control signals from the control mechanism 28.

Figure 2A:
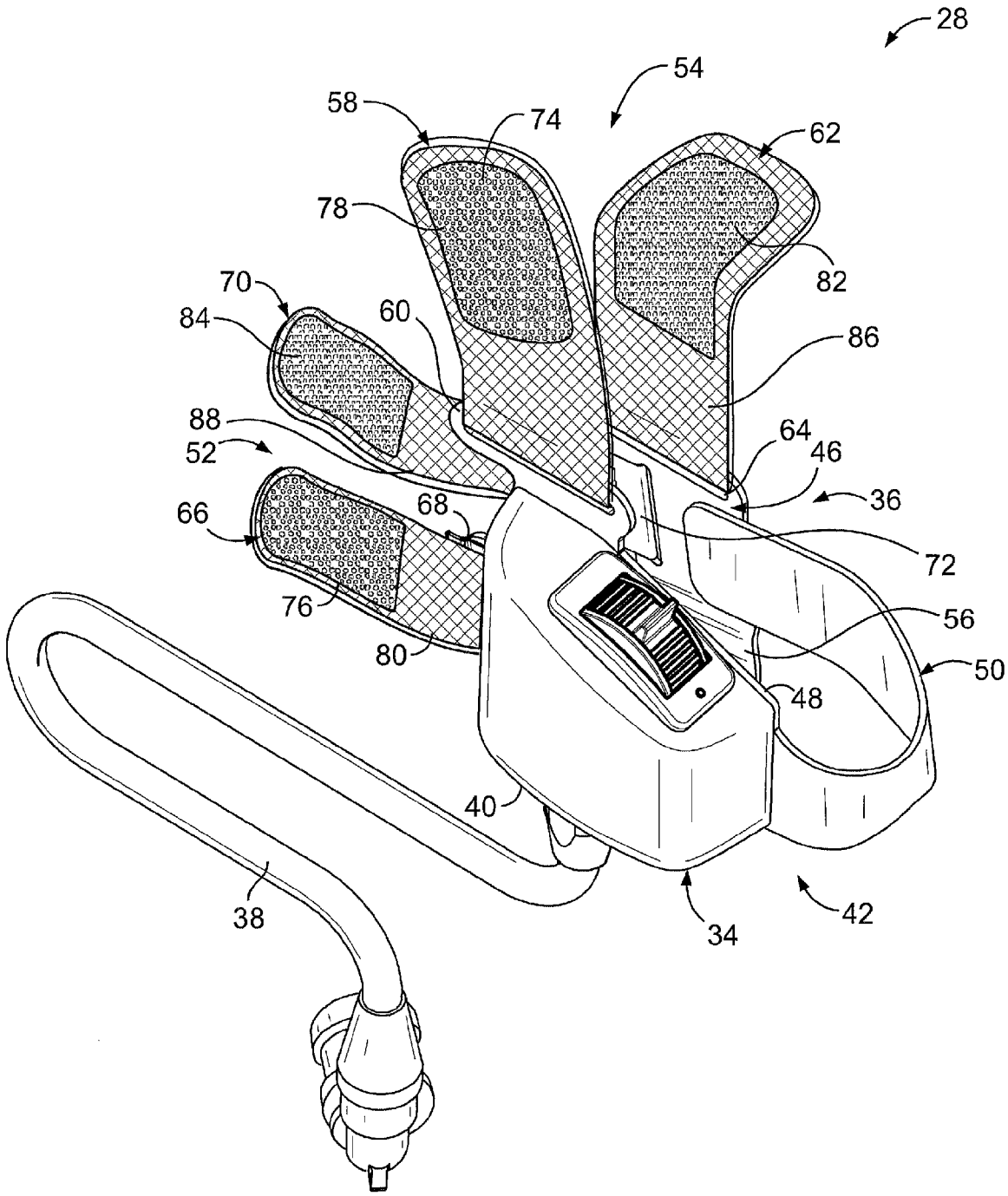
FIG. 2A is a top right front perspective view of an example control mechanism mountable to a firing device.
Figure 2B:
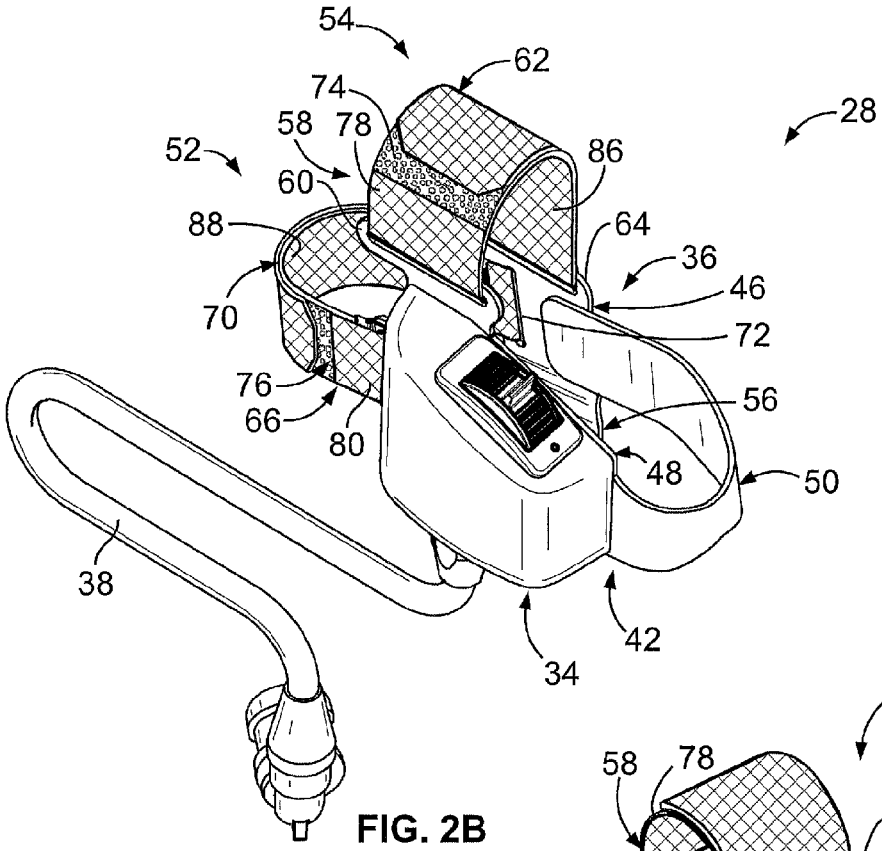
FIG. 2B is a top right front perspective view of the control mechanism of FIG. 2A in an alternative configuration.
Figure 2C:
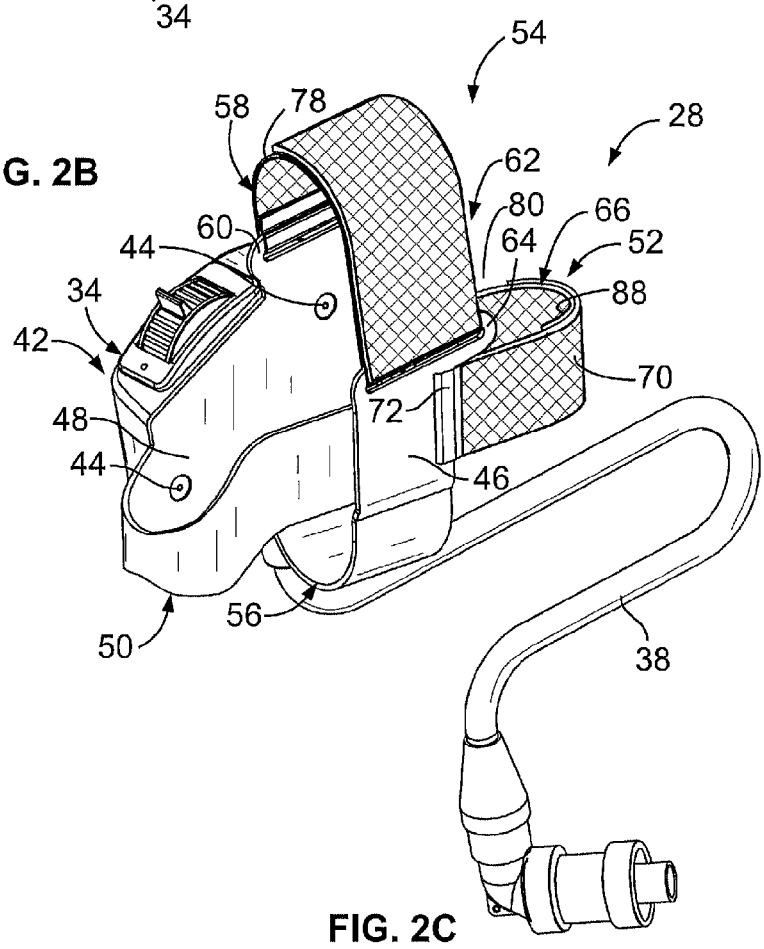
FIG. 2C is a top right rear perspective view of the control mechanism of FIG. 2B.

Referring now to FIGS. 2A-C, an example control mechanism 28 is shown in various perspective views. FIG. 2A and FIG. 2B are top right front perspective views of an example control mechanism 28. FIG. 2B is a top right rear perspective view of an example control mechanism 28. The control mechanism 28 includes an actuation unit 34 and an attachment apparatus 36. A connector cable 38 may also be connected to the bottom 40 of the actuation unit 34 for carrying transmitted signals from the actuation unit.

In the example shown, the actuation unit 34 is secured adjacent to the right side 42 of the attachment apparatus 36 for use with the example right-handed firing device 22 described above. The attachment apparatus 36 supports the actuation unit 34, and the actuation unit may be secured to the attachment apparatus 36, for example, via a pair of screws 44 or by another suitable coupling apparatus. Those skilled in the art will recognize that the control mechanism 28 described herein may be designed for use with firing devices operable by either the right or left hand of an operator. Accordingly, in other embodiments, the actuation unit may also be secured adjacent to the left side of the attachment apparatus.

The attachment apparatus 36 may be constructed from any material or combination of materials suitable to secure the control mechanism to the stock 30 of the firing device 22. In the example embodiment of FIGS. 2A-C, the attachment apparatus 36 may be constructed from a combination of aluminum alloy or stainless steel and elastic fabric having Velcro®-style hook-and-loop fasteners.

As seen in the example control mechanism 28 of FIGS. 2A-C, the attachment apparatus 36 includes two side attachment panels 46, 48 and multiple securing members 50, 52, 54, 56, which may be used to secure the attachment apparatus to the stock 30 of the firing device 22. In the example shown, the attachment panels include a left panel 46 and a right panel 48. The left panel 46 and the right panel 48 respectively abut the left side face 47 and right side face 49 of the stock 30 when the attachment apparatus 36 is secured to the stock as shown in FIGS. 5A-D, which are described further below. The right panel 48 may serve as an attachment site for some of the securing members as well as the actuation unit 34, which may be positioned adjacent to the right panel of the attachment apparatus 36. Similarly, the left panel 46 may serve as an attachment site for the remaining securing members. The attachment panels 46, 48 of the example control mechanism of FIGS. 2A-C, may be made of aluminum alloy or stainless steel.

The securing members of the example control mechanism of FIGS. 2A-C include four securing members—a front securing member 50, a rear securing member 52, a top securing member 54, and a bottom securing member 56. The securing members may be used to releasably secure the attachment apparatus 36 to the stock 30 of the firing device 22. The front securing member 50 and bottom securing member 56 in the example control mechanism 28 shown are metallic braces connected to the right attachment panel 48 and the left attachment panel 46. As seen in FIG. 2B and FIG. 2C, the front brace 50 is contiguous with the right panel 48 and attached to the left panel 46. Similarly, the bottom brace 56 is contiguous with both the right panel 48 and the left panel 46. As seen, the front brace 50 and the bottom brace 56 of the example attachment apparatus 36 have a generally U-shaped configuration, which allows the braces to respectively receive and mate with the front and the bottom of the stock 30. The respective receipt of the front portion and bottom portion of the stock 30 in the front brace 50 and the bottom brace 56 is further described below in reference to FIGS. 5A-D. The shape and configuration of the braces provide for quick and easy installation of the control mechanism on the stock of the firing device.

The top securing member 54 and rear securing member 52 of the example control mechanism 28 shown are releasably attachable straps that may be constructed of elastic fabric as shown in FIG. 2A. The top securing member 54 includes a top right elastic strap 58 secured to the top 60 of the right attachment panel 48 and a top left elastic strap 62 secured to the top 64 of the left attachment panel 46. In a similar fashion, the rear securing member 52 includes a rear right elastic strap 66 attached to the side 68 of the right attachment panel 48 and a rear left elastic strap 70 attached to the side 72 of the left attachment panel 46.

Additionally and as seen in FIG. 2A, the top straps 58, 62 and the rear straps 66, 70 each include a coupling mechanism for coupling the corresponding straps to one another. In the example control mechanism of FIG. 2A, the coupling mechanism may be a set of Velcro®-style hook-and-loop fasteners applied to the surfaces of the straps. In particular, the top right strap 58 and the rear right strap 66 respectively include a patch of loop fasteners 74, 76 applied to the exterior surface 78, 80 of each strap. Correspondingly, the top left strap 62 and the rear left strap 70, in this example, respectively include a patch of hook fasteners 82, 84 applied to the interior surface 86, 88 of each strap. Those skilled in the art will understand that other suitable releasably securable coupling mechanisms may be employed such as, for example, snap fasteners, buttons, buckles, zippers, and the like.

As shown in FIG. 2B and FIG. 2C, the hooks 82 of the top left strap 62 mesh with the loops 74 of the top right strap 58 securing the top straps 58, 62 to each other. Likewise, the hooks 84 of the rear left strap 70 mesh with the loops 76 of the rear right strap 66 securing the rear straps 66, 70 to each other. The hook-and-loop fasteners provide for quick and easy release of the control mechanism from the stock of the firing device. As mentioned above, other suitable releasably securable coupling mechanisms may be employed including, for example, snap fasteners, buttons, buckles, zippers, and the like.

In the example control mechanism 28 shown, the attachment apparatus 36 is designed to fit and secure onto the stock 30 of an M240 machine gun 22. Those skilled in the art will recognize that more or less panels, braces, and/or securing members may be provided with other embodiments, such as other embodiments for use with firing devices having differently shaped stocks.

Figure 3:
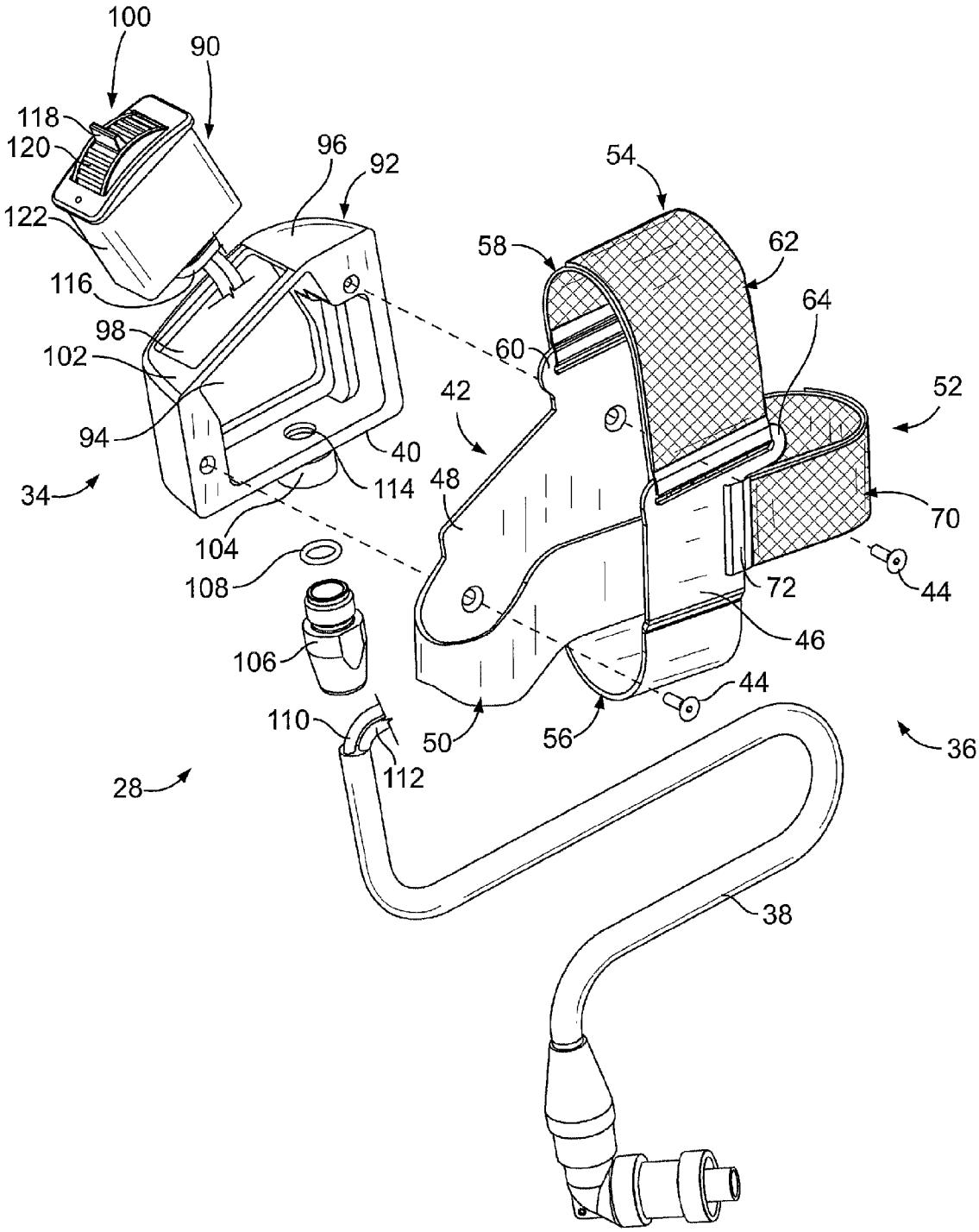
FIG. 3 is an exploded perspective view of the control mechanism of FIGS. 2A-C.

Referring now to FIG. 3, an exploded view of the example control mechanism 28 of FIGS. 2A-C is shown. As discussed above, the control mechanism 28 includes an actuation unit 34 and an attachment apparatus 36. A connector cable 38 is also shown, which may also be attached to the bottom 40 of the actuation unit 34.

The actuation unit 34 may include an actuation component 90 and housing 92 for the actuation component. The housing 92 of the actuation unit 34 may be secured to the right attachment panel 48 of the attachment apparatus via a pair of screws 44. Additionally, the housing 92 may include a cavity 94 formed in the housing such as an interior chamber that houses the actuation component 90. Further, the upper face 96 of the housing may include an opening 98 through which an actuator 100 of the actuation component 90 may extend. Moreover, the opening 98 in the upper face 96 may be positioned on an angled portion 102 of the upper face 96 of the housing 92. The angled portion 102 of the upper face 96 may slope in a downward direction relative to the front of the attachment apparatus 36 and along the forward length of the housing 92. The angled portion 102 of the upper face 96 of the housing 92 enables the actuation component 90 to be positioned at an angle relative to the housing. As explained further below with reference to FIG. 8, an angled configuration of the actuation component 90 relative to the housing 92 provides an ergonomic interface for an operator of the control mechanism 28 when the control mechanism is secured to a firing device 22.

The housing 92 of the actuation unit 90 may also include a threaded socket 104 positioned on the bottom 40 of the housing for receipt of a threaded connector head 106 of the connector cable 38. A gasket 108, such as an o-ring, may be placed within the socket 104 providing a sealed engagement between the housing 92 of the actuation unit 34 and the connector cable 38. As shown in FIG. 3, the connector cable 38 includes three wires—a supply wire 110 and a output wire 112, and a circuit ground wire 116. The supply wire 110, the output wire 112, and the circuit ground wire 116 may access the interior chamber 94 of the housing 92 via an aperture 114 formed in the bottom 40 of the housing and terminate at the actuation component 90. The supply wire 110 may provide a predefined voltage to the actuation component; the output wire 112 may transmit the control signals from the actuation component through the connector cable; and the circuit ground wire may provide a path to ground. In the example control mechanism 28 described herein, the control signals may include variable voltage outputs from the actuation component 90 that correspond to the position of the actuation component. Those skilled in the art will understand that other suitable electrical or electronic control signals, including wired or wireless control signals, may be employed.

The actuation component 90 of the control mechanism 28 will now be discussed in more detail. The actuation component 90 may include a transducer to detect a physical change in the actuation component and generate a signal based on a detection of the physical change. For example, the transducer may convert a sense of the change in position of the actuation component to an electrical signal representative of the position of the actuation component. Accordingly, any suitable switch or sensor may be employed as an actuation component for the control mechanism. Switches may be employed to toggle between various defined states, such as ON/OFF states. Alternatively, sensors may be employed to provide a variable voltage output based on the actuation of the sensor.

In the example control mechanism 28 described herein with reference to an example turret control application, the actuation component 90 may be a Hall effect sensor that includes a self-centering single axis actuator having a rocker switch style mounting. As seen in FIG. 3, the Hall effect sensor 90 includes an actuator paddle or tab 118 mounted to a moveable wheel 120 disposed within the body 122 of the sensor. The actuator tab 118 may be used to move the wheel 120 in a forward or backward direction relative to the firing device 22. Accordingly, the actuator tab 118 may be used to adjust the position of the wheel 120 from a neutral position to an actuated position such as a forward or a backward displacement. The wheel 120 may be biased by springs (not shown) within the body 122 of the sensor 90 such that the actuator tab 118 is positioned in the center of the sensor in a neutral position. When an operator releases the actuator tab 118, the springs return the actuator tab 118 and wheel 120 to the neutral position from an actuated position. A suitable sensor may be an HTW Hall Effect Proportional Output Thumbwheel available from OTTO Engineering, Inc. as part number HTW-2A12A22.

The spring-biased rotary Hall effect sensor 90 in this example embodiment generates variable voltage outputs based on and corresponding to the position of the moveable wheel of the sensor. Activation of the actuator tab, e.g., pushing the actuator tab 118 in either a forward or backward direction, generates a variable voltage output corresponding to the particular position of actuator tab of the sensor 90.

For example, a reference voltage of 5 volts (V) may be supplied to the Hall effect sensor 90. With the actuator tab 118 positioned in the neutral position, the output signal generated by the sensor 90 may be around 2.5V. Pushing the actuator tab 118 in a forward direction may change the voltage output of the sensor 90. When the actuator tab 118 is disposed in a forward direction, the output signal from the sensor 90 may be between 1.0V and 2.5V depending on how far forward the actuator tab is disposed, i.e., the distance of the actuator from a neutral position. Pushing the actuator tab 118 in a backward direction may similarly change the voltage output of the sensor 90. When the actuator 118 is disposed in a backward direction, the output signal from the sensor 90 may be between 2.5V and 4.0V also depending on how far backward the actuator tab is disposed. The output signal may be transmitted via the connector cable 38 to a controller or some other like device having a signal decoder that takes some action in response to the particular voltage signal received from the sensor 90.

Figure 4:
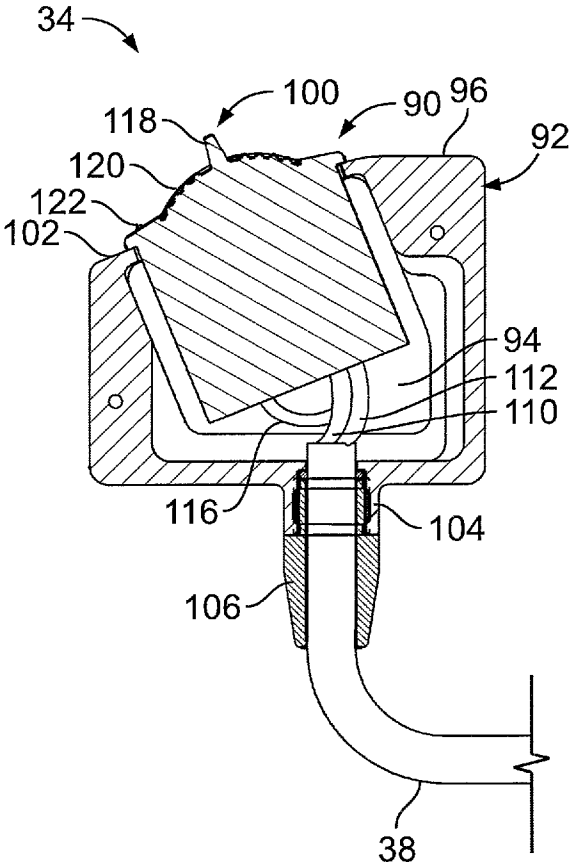
FIG. 4 is a side cross-sectional view of an actuation unit of the control mechanism of FIGS. 2A-C.

Referring now to FIG. 4, a left side cross-section view of an actuation unit 34 is shown with a connector cable 38 attached. As seen in FIG. 4, the actuation component 90 and actuator tab 118 of the actuation unit 34 are positioned at an angle relative to the housing 92 of the actuation unit. Additionally, the supply wire 110, output wire 112, and circuit ground wire 116 of the connector cable 38 terminate at the actuation component 90, which respectively supply a voltage to the actuation component, transmit signals from the actuation component, and provide a path to ground. In one embodiment of an example control mechanism, the interior chamber 94 of the actuation unit housing 92 may be filled with a potting compound to provide resistance from shock or vibration and to exclude moisture or other corrosive agents. A suitable potting compound may be 3M™ Scotch-Weld™ Epoxy Potting Compound available from 3M of St. Paul, Minn.

FIGS. 5A-D are various detailed views showing how an example control mechanism secures to the stock 30 of a firing device 22. As seen in the top left perspective view of FIG. 5A, the top left strap 62 and the top right strap 58 wrap around the top 124, or comb, of the stock 30. The hook fasteners 82 on the interior surface 86 of the top left strap 62 mesh with the loop fasteners 74 on the exterior surface 78 of the top right strap 58 securing the top straps 58, 62 to the comb 124 of the stock 30. Similarly, the rear left strap 70 and the rear right strap 66 wrap around the back 126, or butt, of the stock 30. Like the top straps 58, 62, the hook fasteners 84 on the interior surface 88 of the left rear strap 70 mesh with the loop fasteners 76 on the exterior surface 80 of the right rear strap 66 securing the rear straps 66, 70 to the butt 126 of the stock 30.

Figure 5A:
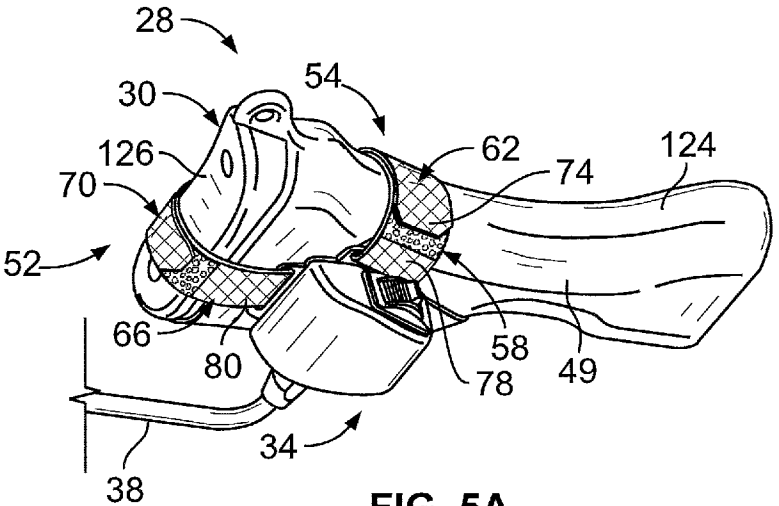
FIG. 5A is a top left front perspective view of an example control mechanism mounted to the stock of a firing device.
Figure 5B:
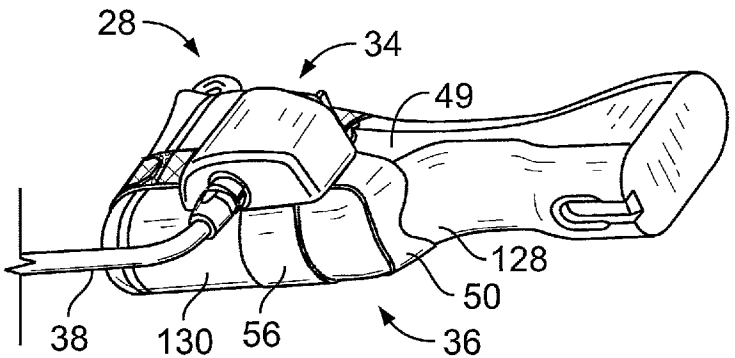
FIG. 5B is a bottom right front perspective view of the control mechanism of FIG. 5A mounted to the stock of a firing device.

Referring now to the bottom right perspective view of FIG. 5B, the front brace 50 and the bottom brace 56 of the attachment apparatus 36 for the example control mechanism 28 are shown. As shown, the front brace 50 receives the front 128 of the stock 30, and the bottom brace 56 receives the bottom 130 of the stock. In the example control mechanism 28 of FIG. 5B, the front brace 50 and the bottom brace 56 are contoured to match the particular shape of the stock 30 for an M240 machine gun 22. Those skilled in the art will recognize that other embodiments of control mechanisms may include a front brace and a bottom brace alternatively contoured to respectively match the front and bottom of stocks for other firing devices.

Figure 5C:
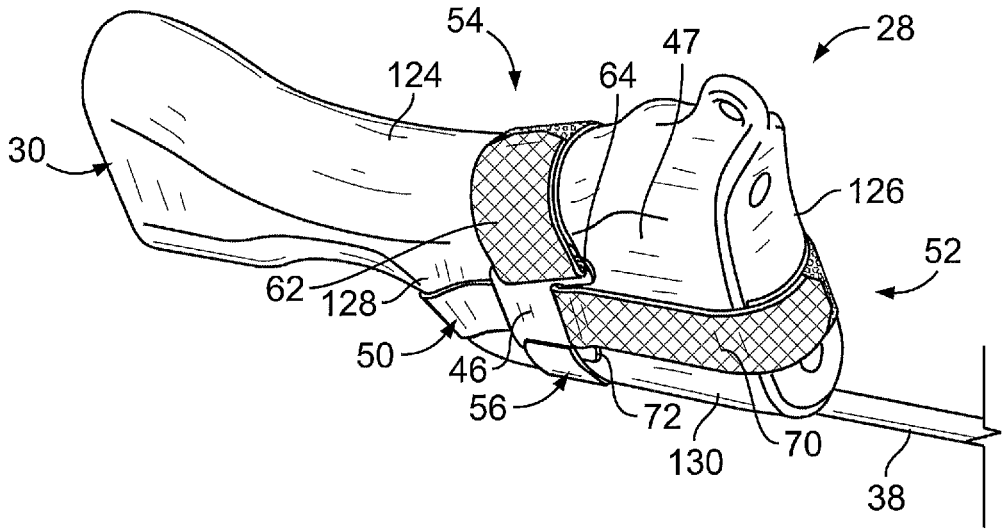
FIG. 5C is a top left rear perspective view of the control mechanism of FIG. 5A mounted to the stock of a firing device.
Figure 5D:
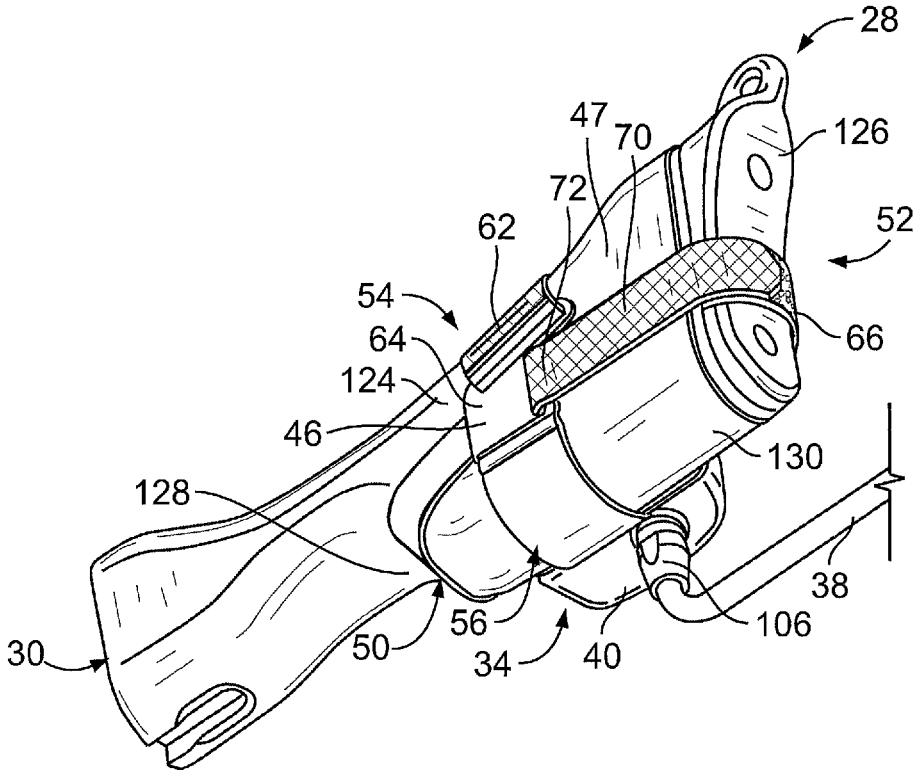
FIG. 5D is a bottom left rear perspective view of the control mechanism of FIG. 5A mounted to the stock of a firing device.

FIG. 5C and FIG. 5D respectively show top and bottom left rear perspective views of the example control mechanism 28 of FIGS. 5A-B. As shown, the top left strap 62 and rear left strap 70 are respectively secured to the top 64 and side 72 of the left attachment panel 46. The top left strap 62 wraps around the comb 124 of the stock 30 and secures to the top right strap 58 via the hook-and-loop fasteners 82, 74. Similarly, the rear left strap 70 wraps around the butt 126 of the stock 30 and secures to the rear right strap 66 also via the hook-and-loop fasteners 84, 76.

FIG. 5C and FIG. 5D also illustrate how an example control mechanism 28 may be installed on the stock 30 of a firing device 22. With regard to the example control mechanism 28, an operator may first ensure the pair of top straps 58, 62 and the pair of rear straps 66, 70 are uncoupled from one another. The operator may then position the control mechanism 28 beneath and slightly in front of the stock 30 aligning the attachment apparatus 36 with the stock. Next, the operator may raise the control mechanism 28 towards the bottom 130 of the stock such that the stock 30 slides between the left attachment panel 46 and the right attachment panel 48 of the attachment apparatus 36. As the operator continues to raise the control mechanism 28 towards the stock, the front 128 of the stock 30 and the bottom 130 of the stock are respectively received in the front brace 50 and the bottom brace 56.

When the stock 30 is fully received within the front brace 50 and the bottom brace 56, the operator may then secure the pair of top straps 58, 62 and the pair of rear straps 66, 70. An operator, for example, may wrap the top right strap 58 followed by the top left strap 62 around the comb 124 of the stock 30 securing the top left strap to the top right strap via the hook-and-loop fasteners 82, 74. An operator may then wrap the rear right strap 66 followed by the rear left strap 70 around the butt 126 of the stock 30 also securing the rear left strap to the rear right strap via the hook-and-loop fasteners 84, 76. In embodiments that include straps constructed of an elastic material, an operator may tighten the control mechanism to the stock by further pulling, for example, the top left strap 62 and/or the top right strap 58 further around the comb 124 of the stock 30 before securing the straps to one another. A similar procedure may be employed to tighten the rear pair of straps 66, 70 as well.

Figure 6:
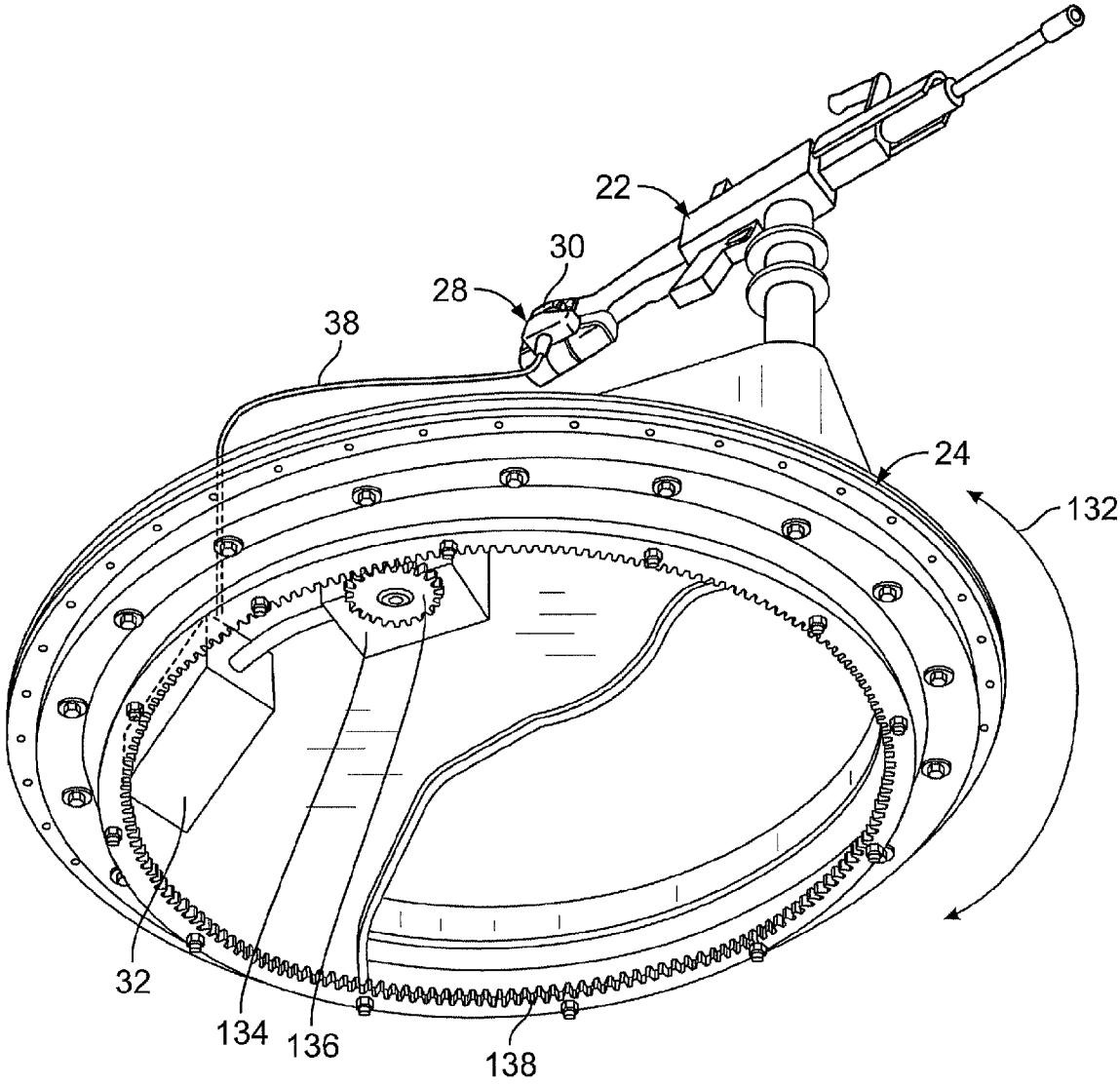
FIG. 6 is a perspective view of a control mechanism mounted to a firing device of a rotatable turret and connected to a controller of a turret drive system.

Referring now to FIG. 6, an example control mechanism 28 is shown used in an example application, in particular, to control the rotation of a turret 24. As seen in FIG. 6, the control mechanism 28 is mounted to the stock 30 of a firing device 22. The firing device 22 may be mounted or positioned within a rotatable turret 24. Arrow 132 indicates the turret 24 may rotate in both a clockwise and a counterclockwise direction. The control mechanism 28 is shown connected via the connector cable 38 to a controller 32 positioned beneath the rotatable turret 24. The controller 32 is connected to a motor 134 used to drive the rotation of the turret 24. The motor 134 includes a drive gear 136, which meshes with a ring gear 138 mounted to the turret 24. Accordingly, as the motor 134 spins the drive gear 136, the drive gear transmits the torque to the ring gear 138, which causes the turret 24 to rotate. As stated above, rotation of a turret is just one application for which the control mechanism mountable to a firing device may be employed.

Figure 7:
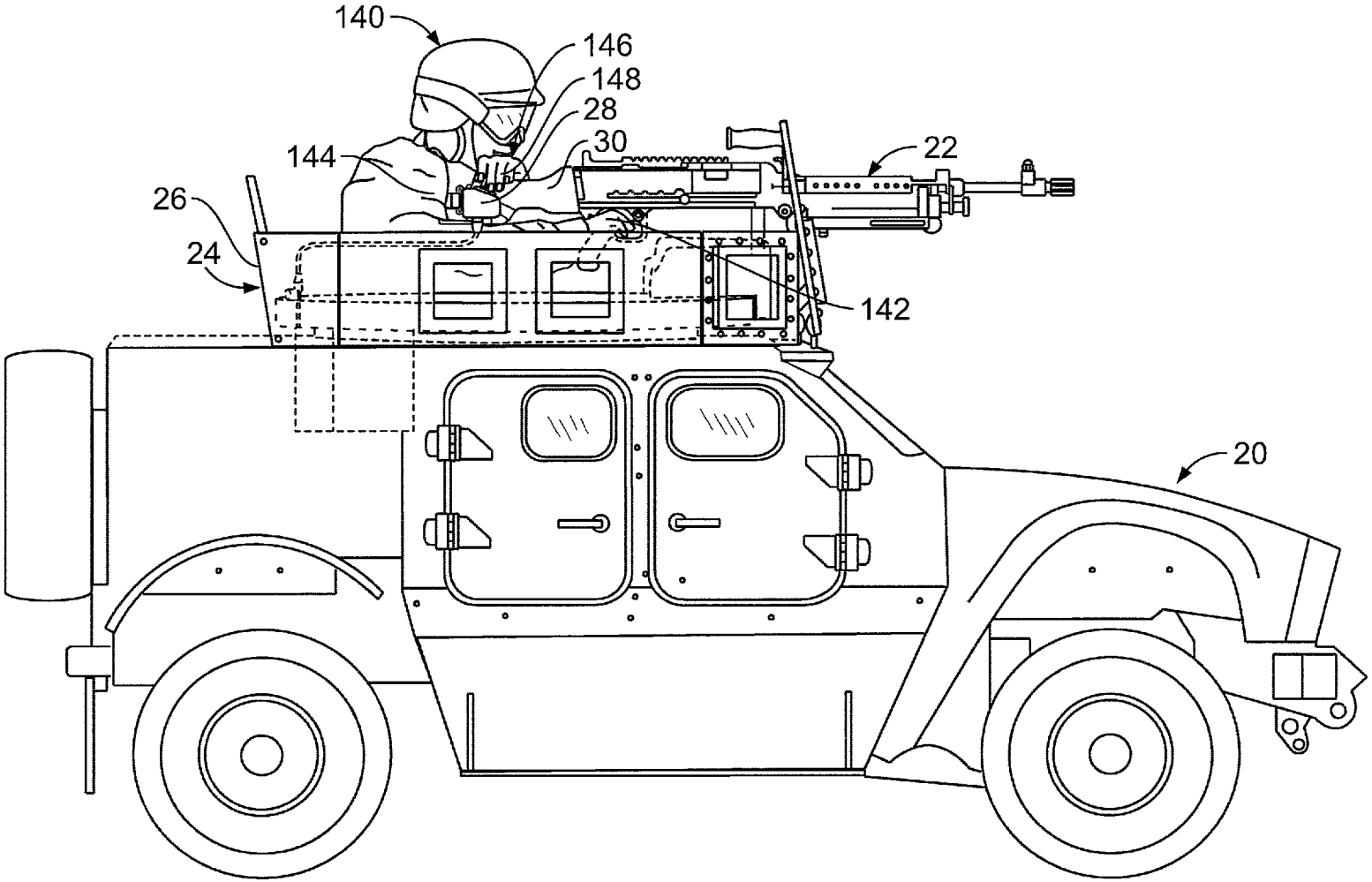
FIG. 7 is a profile view of an armored vehicle turret with an operator positioned to operate a firing device and actuation unit of the control mechanism.

In reference to FIG. 7, a right profile view of an armored vehicle 20 having a rotatable turret 24 with shielding 26 and a firing device 22 with the control mechanism 28 attached to the stock 30 of the firing device is shown in an example mode of operation. An operator 140 is also shown positioned within the turret 24. The position of the operator 140 shown in FIG. 7 corresponds to a typical position for operators of certain turret mounted weapons. In this particular example, the operator grips the firing device 22 with his right hand 142 and secures the stock 30 of the firing device 22 against his front right shoulder 144. The operator 140 then wraps his left hand 146 over the comb 124 of the stock so that the fingers 148 of his left hand 146 rest on the right side of the stock 30. In this position, an operator 140 may effectively stabilize and aim the firing device 22. Additionally, in this position, recoil from the firing device 22 may be transmitted into the body of the operator through the stock 30.

The control mechanism 28 described herein is designed to secure to the stock 30 such that an operator 140 may maintain a natural position when simultaneously operating the firing device and the control mechanism. For the purposes of illustration, the example control mechanism 28 shown includes as an actuation component 90 the rotary Hall effect sensor with actuator tab 118 as described above in reference to FIG. 3. As seen in FIG. 7, the control mechanism 28 is installed on the stock 30 where the operator 140 naturally positions the fingers 148 of his left hand 146. Accordingly, the operator 140, in this example, may use the fingers 148 of his left hand 146 to actuate the control mechanism 28 and rotate the turret 24.

Figure 8:
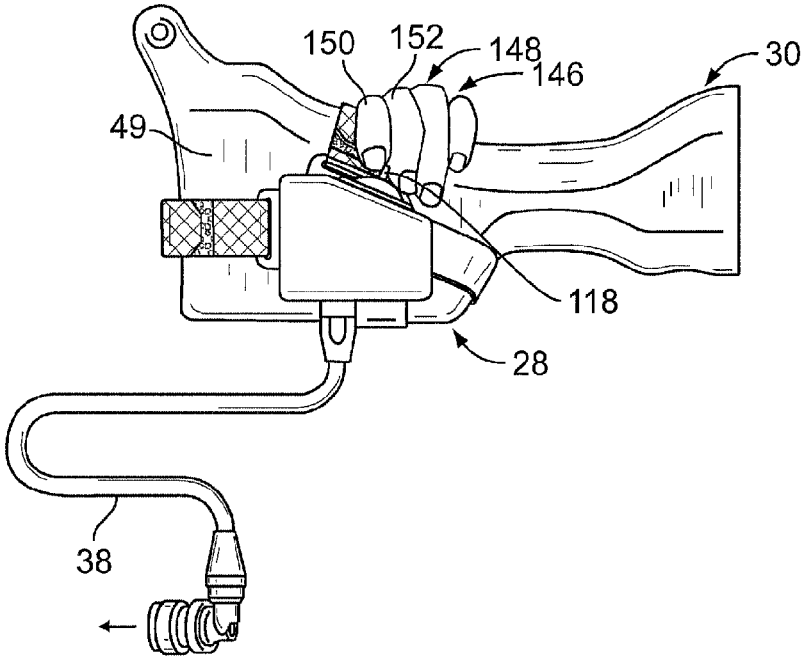
FIG. 8 is a side view of the stock of a firing device with the control mechanism mounted to the stock illustrating a hand of an operator positioned to operate the actuation unit of the control mechanism.

FIG. 8 shows in more detail the position of the fingers 148 of the left hand 146 of the operator 140 in relation to the actuator tab 118 of the control mechanism 28. As shown in FIG. 8, the actuator tab 118 is positioned in a central neutral position. The actuator tab 118, in this example, is shown positioned between the index finger 150 and middle finger 152 of the left hand 146 of the operator 140. From this position, the operator 140 may push the actuator tab 118 forward in a first mode of operation, or pull the actuator tab backwards in a second mode of operation.

As mentioned above, the angled configuration of the actuation component 90 (FIG. 3) provides an ergonomic interface between the actuator tab 118 of the control mechanism 28 and the fingers 148 of the operator. As can be seen in FIG. 8, the angled configuration positions the actuator tab 118 at the location in which an operator has been trained or may be accustomed to placing his or her left hand 146. In particular, the angled configuration may take into account the particular positions of the index finger 150 and the middle finger 152 of the left hand 146 of the operator. For example and as shown in FIG. 8, when the left hand 146 of the operator is wrapped around the top 124 (FIG. 5A) of the stock 30, the index middle finger 152 may be positioned slightly below the index finger 150 of the operator. Accordingly, the angled configuration of the actuation component 90 may accommodate the slight difference in finger position.

Figure 9A:
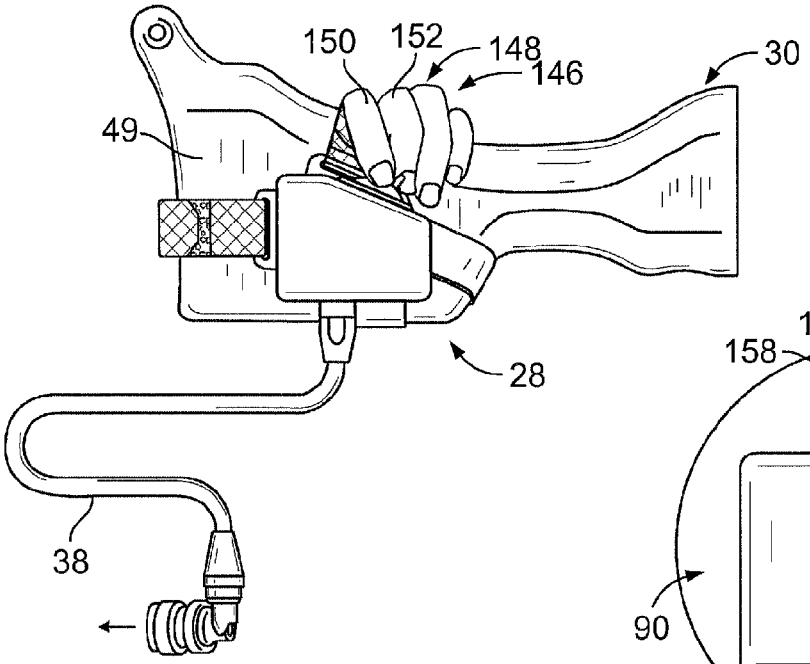
FIG. 9A is a side view of the stock of a firing device with the control mechanism mounted to the stock illustrating a hand of an operator actuating the actuation unit of the control mechanism in a first mode of operation.

FIG. 9A-B and FIG. 10A-B respectively show a first and second mode of operation using the control mechanism 28 mounted to the stock 30 of a firing device 22. As seen in the example of FIG. 9A, the operator 140 uses his index finger 150 to push the actuator tab 118 in a forward direction relative to the operator. The connector cable 38 transmits a signal corresponding to the forward position of the actuator tab 118.

Figure 9B:
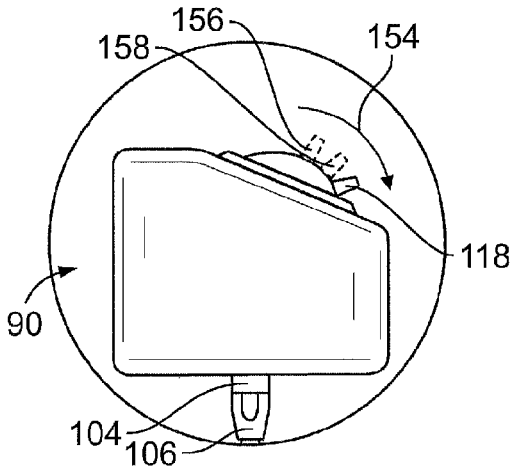
FIG. 9B is a side view of the actuation unit of FIG. 9A illustrating the actuation of the actuation unit in first mode of operation.

The arrow 154 of FIG. 9B indicates the forward direction of movement of the actuator tab 118. Additionally, FIG. 9B shows the actuator tab 118 pushed forward at maximum displacement from the neutral position. The tab outlines 156, 158 illustrate the progression of the actuator tab 118 as the tab moves forward. The rotational speed of the turret 24 may vary depending on the forward displacement of the actuator tab 118. For example, if the actuator tab 118 is pushed fully forward as shown in FIG. 9B, the sensor 90 may transmit to a controller 32 a voltage output signal of around 1 V. Based on the 1V signal received, the controller 32 may determine an appropriate rotational speed and instruct the drive motor 134 to rotate the turret 24 counterclockwise at maximum speed, such as 10 RPM. However, if the actuator tab 118 is pushed halfway forward, as indicated by the second tab outline 158 of FIG. 9B, the sensor 90 may transmit to the controller 32 a different voltage output signal of around 1.75V for example. Based on this different voltage output signal, the controller 32 may determine a different rotational speed and instruct the drive motor 134 to rotate the turret 24 counterclockwise at half-speed, such as 5 RPM.

Figure 10A:
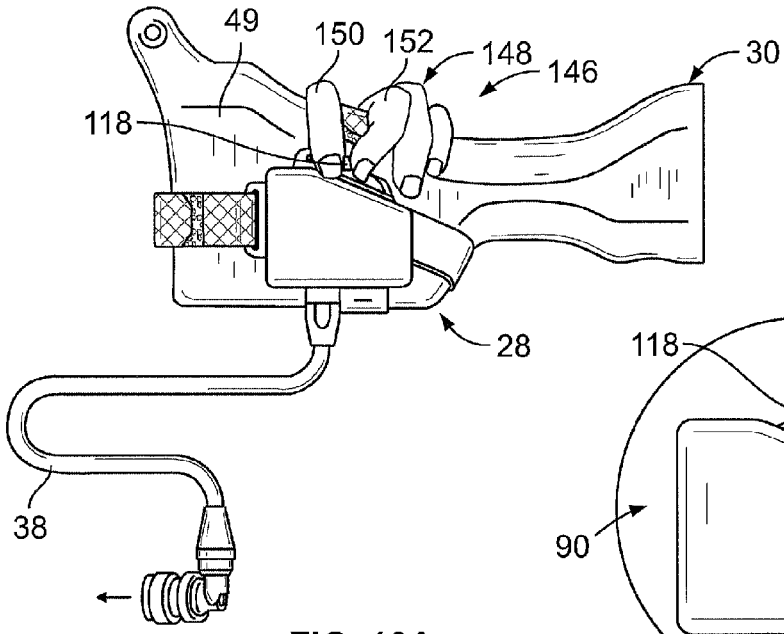
FIG. 10A is a side view of the stock of a firing device with the control mechanism mounted to the stock illustrating a hand of an operator actuating the actuation unit of the control mechanism in a second mode of operation.
Figure 10B:
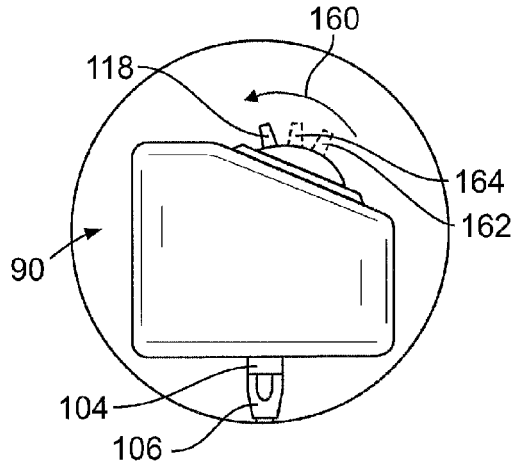
FIG. 10B is a side view of the actuation unit of FIG. 10A illustrating the actuation of the actuation unit in second mode of operation.

FIG. 10A-B illustrate a second mode of operation using the example control mechanism 28. As seen in FIG. 10A, the operator 140, in this example, uses his middle finger 152 to pull the actuator tab 118 in a backwards direction relative to the operator. The connector cable 38 similarly transmits the signal corresponding to the backward position of the actuator tab 118.

The arrow 160 of FIG. 10B indicates the backward direction of movement of the actuator tab 118. FIG. 10B also shows the actuator tab 118 pulled backward at maximum displacement from the neutral position with tab outlines 162, 164 indicating the progression of the tab as the tab moves backward. Again, the rotational speed of the turret 24 may depend on the backward displacement of the actuator tab 118. As another example, if the actuator tab 118 is pulled fully backward as shown in FIG. 10B, the sensor 90 may transmit to the controller 32 a voltage output signal of around 4V. Based on the 4V signal received, the controller 32 may instruct the drive motor 134 to rotate the turret 24 clockwise at maximum speed, such as 10 RPM. However, if the actuator tab 118 is pulled halfway backward, as indicated by the second tab outline 164 of FIG. 10B, the sensor 90 may transmit to the controller 32 a different voltage output signal of around 3.25V for example. Based on this different voltage output signal, the controller 32 may instruct the drive motor 134 to rotate the turret 24 clockwise at half-speed, such as 5 RPM.

When the operator 140 releases the actuator tab 118, the biasing springs (not shown) of the rotary Hall effect sensor 90 return the actuator tab to the neutral position as shown in FIG. 8. When the actuator tab 118 returns to the neutral position, the voltage output signal transmits a neutral voltage signal of around 2.5V. When the controller 32 receives the neutral voltage signal, the controller may instruct the drive motor 134 to cease rotation of the turret 24.

Figure 11A:
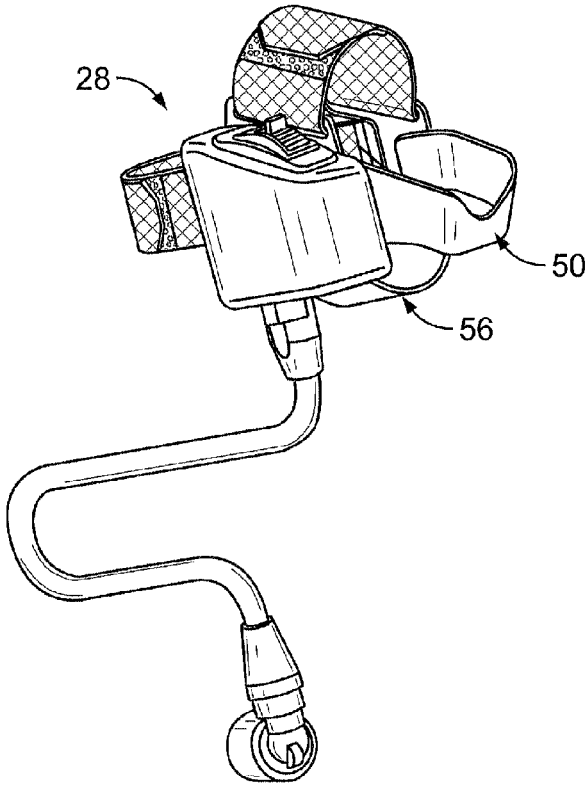
FIG. 11A is a top right front perspective view of an alternative embodiment of a control mechanism.
Figure 11B:
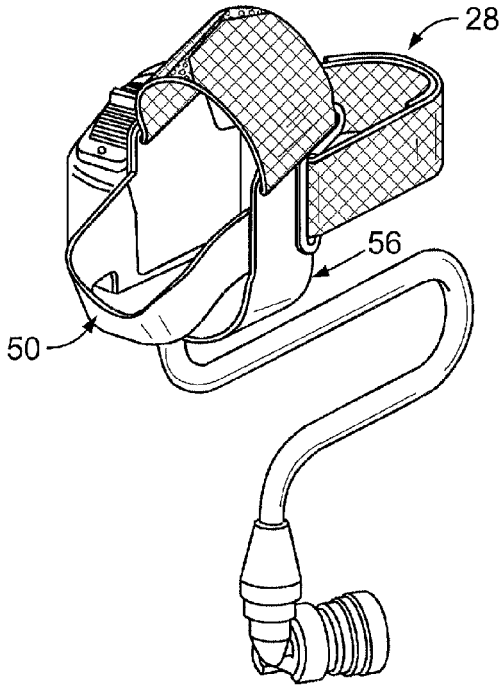
FIG. 11B is a top right rear perspective view of an alternative embodiment of a control mechanism.

Finally, FIGS. 11A-B are perspective views of an alternative embodiment of the control mechanism 28. In particular, the control mechanism 28 shown in FIGS. 11A-B is designed for the M249 machine gun (United States Designation Light Machine Gun, 5.56 mm, M249). As seen in FIGS. 11A-13, the front brace 50 and the lower brace 56 exhibit a different contour that matches the particular stock of the M240 machine gun.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A control mechanism securable to a firing device comprising:

an actuation component adapted to generate control signals in response to activation of the actuation component; and an attachment apparatus adapted to support the actuation component adjacent to a stock of the firing device, the attachment apparatus having at least one securing member for securement of the attachment apparatus to the stock of the firing device, wherein the at least one securing member of the attachment apparatus further comprises a first brace having a U-shaped configuration, the first brace adapted to matingly receive one portion of the stock, and a second brace having a U-shaped configuration, the second brace adapted to matingly receive another portion of the stock.

2. The control mechanism of claim 1 wherein the attachment apparatus is adapted to be releasably secured to the stock.

3. The control mechanism of claim 2 wherein the attachment apparatus is adapted to position the actuation component adjacent to a side face of the stock.

4. The control mechanism of claim 3 wherein the attachment apparatus further comprises at least one side panel, the side panel adapted to abut the side face of the stock.

5. The control mechanism of claim 4 wherein the attachment apparatus further comprises a plurality of side panels and the actuation component is positioned adjacent to one of the plurality of side panels.

6. The control mechanism of claim 3 wherein at least one of the first brace or the second brace is positionable on at least one of a front portion of the stock or a bottom portion of the stock.

7. The control mechanism of claim 6 wherein at least one of the first brace or the second brace is adapted to matingly receive a front portion of the stock or a bottom portion of the stock.

8. The control mechanism of claim 3 wherein:

the first brace is a first metallic brace adapted to matingly receive a front portion of the stock; and the second brace is a second metallic brace adapted to matingly receive a bottom portion of the stock.

9. The control mechanism of claim 6 wherein the attachment apparatus further comprises at least one strap positionable on at least one of a top portion of the stock or a rear portion of the stock.

10. The control mechanism of claim 6 wherein the attachment apparatus further comprises:

a first pair of elastic straps positionable on a top portion of the stock, the first pair of elastic straps having a first coupling mechanism for engagement of the first pair of straps; and a second pair of elastic straps positionable on a rear portion of the stock, the second pair of elastic straps having a second coupling mechanism for engagement of the second pair of straps.

11. The control mechanism of claim 3 wherein the control signals include variable voltage outputs corresponding to positions of the actuation component.

12. The control mechanism of claim 11 wherein the actuation component further comprises a Hall effect sensor and an actuator for adjusting the position of the sensor from a neutral position, the actuator being moveable in a first direction and a second direction from the neutral position.

13. The control mechanism of claim 12 wherein the sensor returns to the neutral position from an actuated position when the actuator is released.

14. The control mechanism of claim 12 wherein the actuation component is positioned within a housing of an actuation unit, the actuation unit being secured to the attachment apparatus.

15. The control mechanism of claim 14 wherein the actuator extends through an opening of the housing.

16. The control mechanism of claim 14 wherein the housing of the actuation unit further comprises:

a gasket disposed within a socket attached to the housing, the socket adapted to receive a connector cable for transmitting the control signals generated by the actuation component; and wherein the actuation component is disposed within a cavity formed in the housing of the actuation unit, the cavity being filled with a potting compound.

17. The control mechanism of claim 12 wherein the actuator is angled on a forward downward slope relative to the front of the attachment apparatus.

18. The control mechanism of claim 3 wherein the attachment apparatus is adapted to be secured to a side face of a stock of at least one of an M240 machine gun or an M249 machine gun.

19. The control mechanism of claim 3 wherein the control signals are used to control the rotation of a vehicle turret such that movement of an actuator of the actuation component in a first direction generates signals to cause rotation of the turret in a clockwise direction and movement of the actuator in a second direction generates signals to cause rotation of the turret in a counterclockwise direction; and wherein a rotational speed associated with the turret corresponds to a distance of the actuator from a neutral position.

20. A control system for generating control signals with a control mechanism securable to a firing device comprising:

an actuation component adapted to generate control signals in response to activation of the actuation component;

an attachment apparatus adapted to support the actuation component adjacent to a stock of the firing device, the attachment apparatus having at least one securing member for securement of the attachment apparatus to the stock of the firing device, wherein the at least one securing member of the attachment apparatus further comprises a first brace having a U-shaped configuration, the first brace adapted to matingly receive one portion of the stock, and a second brace having a U-shaped configuration, the second brace adapted to matingly receive another portion of the stock; and a controller coupled to the actuation component for receiving the control signals generated by the actuation component.

21. The control system of claim 20 wherein the controller is adapted to control the rotation of a vehicle turret based on the control signals received from the actuation component.

22. The control system of claim 21 wherein activation of the actuation component in a first direction generates a first control signal, the controller causes the turret to rotate in a clockwise direction in response to receipt of the first control signal; and wherein activation of the actuation component in a second direction generates a second control signal, the controller causes the turret to rotate in a counterclockwise direction in response to receipt of the second control signal.

23. The control system of claim 22 wherein the controller determines a rotational speed based on the control signals received and causes the turret to rotate at the determined rotational speed.

24. The control system of claim 21 wherein the actuation component further comprises a Hall effect sensor and an actuator for adjusting the position of the sensor from a neutral position, the actuator being moveable in a first direction and a second direction from the neutral position; and wherein the sensor returns to the neutral position from an actuated position when the actuator is released.

25. The control system of claim 21 wherein the attachment apparatus positions the actuation component adjacent to a side face of the stock.

26. The control system of claim 25 wherein at least one of the first brace or the second brace is positionable on at least one of a front portion of the stock or a bottom portion of the stock.

27. The control system of claim 26 wherein the attachment apparatus includes at least one strap positionable on at least one of a top portion of the stock or a rear portion of the stock.

* * * * *